US010435942B1

(12) United States Patent
Dunavin

(10) Patent No.: US 10,435,942 B1
(45) Date of Patent: Oct. 8, 2019

(54) COLLAPSIBLE, REMOVABLE PET DOOR

(71) Applicant: Colin V Dunavin, Fort Worth, TX (US)

(72) Inventor: Colin V Dunavin, Fort Worth, TX (US)

( * ) Notice: Subject to any disclaimer, the term of this patent is extended or adjusted under 35 U.S.C. 154(b) by 69 days.

(21) Appl. No.: 15/429,617

(22) Filed: Feb. 10, 2017

Related U.S. Application Data

(60) Provisional application No. 62/296,712, filed on Feb. 18, 2016.

(51) Int. Cl.
*E06B 7/32* (2006.01)
*E05C 19/16* (2006.01)
*E06B 3/70* (2006.01)

(52) U.S. Cl.
CPC ..... *E06B 7/32* (2013.01); *E05C 19/16* (2013.01); *E06B 3/7009* (2013.01); *E06B 2003/7046* (2013.01); *E06B 2003/7049* (2013.01); *E06B 2003/7057* (2013.01)

(58) Field of Classification Search
CPC .. E06B 7/32; E06B 3/7009; E06B 2003/7049; E06B 2003/7057; E06B 2003/7046; E05C 19/16; E05D 3/02
See application file for complete search history.

(56) References Cited

U.S. PATENT DOCUMENTS 1,479,312 A * 1/1924 O'Harrow ..... E06B 9/0638 160/97
2,073,119 A * 3/1937 Phiel ..... E05D 3/02 16/379
4,103,458 A * 8/1978 Booker ..... E06B 7/28 160/114
5,185,954 A * 2/1993 Waddle, Sr. ..... E06B 7/32 49/168
5,946,855 A * 9/1999 Miconi ..... E06B 9/52 160/180
6,164,013 A * 12/2000 Ramsey ..... E06B 7/28 49/169
6,550,828 B2 * 4/2003 Warden ..... E05C 17/54 292/262
7,165,595 B2 * 1/2007 Yamamoto ..... E05F 11/54 160/97

(Continued)

*Primary Examiner* — Katherine W Mitchell
*Assistant Examiner* — Abe Massad
(74) *Attorney, Agent, or Firm* — Kenneth L Tolar

(57) ABSTRACT

A pet door includes an elongated, rectangular panel having a first side edge hingedly attached to the free, pivotal side edge of an exterior door. The panel is formed of an upper section that is foldable onto a lower section to allow the device to be compactly transported or stored. The lower section includes an opening having a movable hatch positioned therein that allows a pet to freely pass through the panel. The upper section of the panel includes a triangular flap hingedly attached to a top edge that is securable to the upper edge of the exterior door. Accordingly, the exterior door is partially opened and the panel is pivoted against the door frame to block the space formed therebetween. The flap is secured to the top edge of the door to overlay the triangular space formed between the exterior door and frame header. Therefore, the panel forms a secure barrier between the open door and the exterior while allowing a pet to freely enter and exit the building.

13 Claims, 2 Drawing Sheets

(56) References Cited

U.S. PATENT DOCUMENTS 8,176,962 B2 * 5/2012 Kilfoyle ..... E06B 7/32
160/180
8,333,037 B2 * 12/2012 Sullivan ..... E06B 9/52
160/105

* cited by examiner

COLLAPSIBLE, REMOVABLE PET DOOR

CROSS REFERENCE TO RELATED APPLICATIONS

This application is entitled to the benefit of provisional patent application No. 62/296,712 filed on Feb. 18, 2016, the specification of which is incorporated herein by reference.

BACKGROUND OF THE INVENTION

The present invention relates to a pet door that can be easily installed and removed without damaging an exterior door or wall.

DESCRIPTION OF THE PRIOR ART

A conventional pet door is typically installed within an opening created on an exterior door or wall. When the owner relocates or the pet dies, the pet door becomes a useless eyesore and the opening significantly strains the building's climate-control system. If the pet door is removed, costly repairs to the exterior door or wall must be completed in order to eliminate or obstruct the opening.

Accordingly, there is currently a need for a pet door that can be easily installed and removed without damaging an exterior wall or door. The present invention addresses this need by providing an elongated panel hingedly attached to a free edge of an exterior door to obstruct a space created when the door is partially opened. The panel includes a movable hatch that allows a pet to freely pass through the obstructed space, as desired.

SUMMARY OF THE INVENTION

A pet door includes an elongated, rectangular panel having a first side edge hingedly attached to the free, pivotal side edge of an exterior door. The panel is formed of an upper section that is foldable onto a lower section to allow the device to be compactly transported or stored. The lower section includes an opening having a movable hatch positioned therein that allows a pet to freely pass through the panel. The upper section of the panel includes a triangular flap hingedly attached to a top edge that is securable to the upper edge of the exterior door. Accordingly, the exterior door is partially opened and the panel is pivoted against the door frame to block the space formed between the door and frame. The flap is secured to the top edge of the door to overlay the triangular space formed between the door and frame header. Therefore, the panel forms a secure barrier between the open door and the exterior while allowing a pet to freely enter and exit the building.

It is therefore an object of the present invention to provide a pet door that can be easily removed and stored.

It is therefore another object of the present invention to provide a pet door that can be installed and removed without damaging an exterior wall or door.

Other objects, features, and advantages of the present invention will become readily apparent from the following detailed description of the preferred embodiment when considered with the attached drawings and the appended claims.

DESCRIPTION OF THE PREFERRED EMBODIMENT

Figure 1:
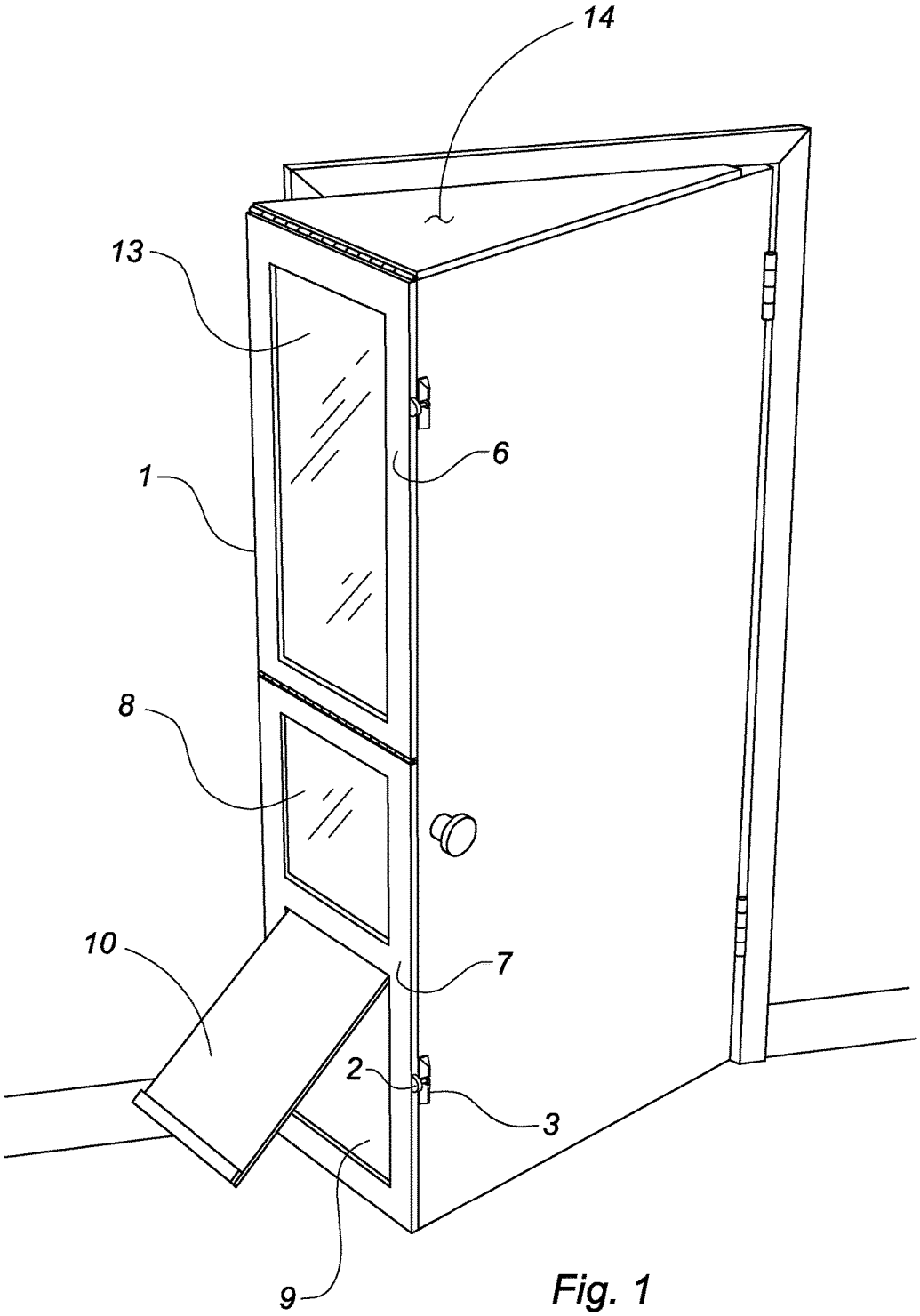
FIG. 1 is a perspective view of an existing building door with the pet door according to present invention installed thereon.
Figure 2:
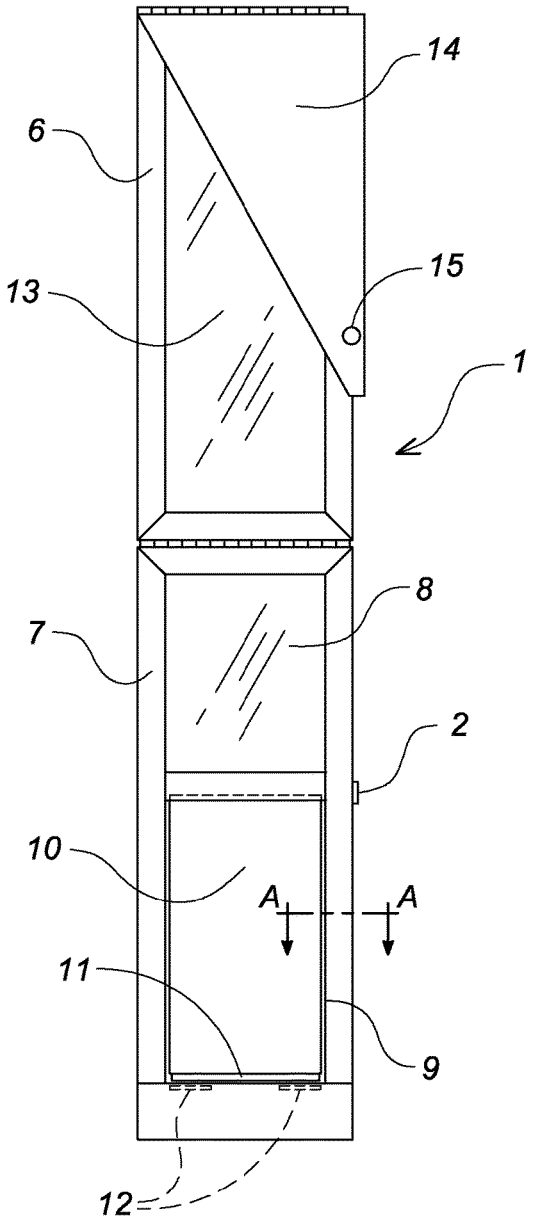
FIG. 2 is a front, plan view of the pet door.
Figure 3:
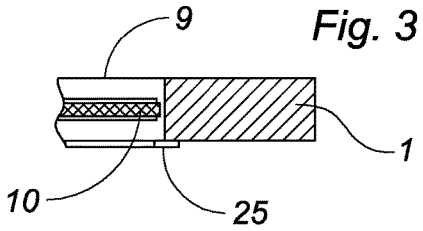
FIG. 3 is a sectional view of the panel taken along A-A in FIG. 2.
Figure 4:
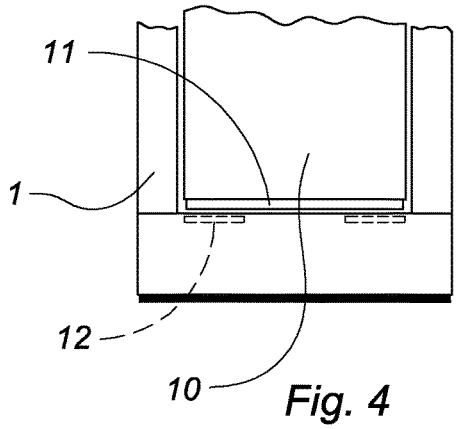
FIG. 4 is a cutaway view of the lower section of the panel.
Figure 5:
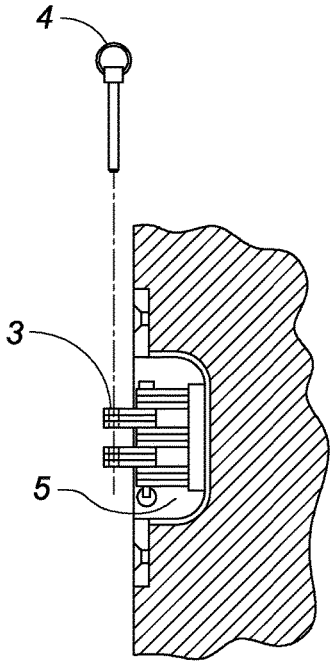
FIG. 5 is an isolated view of the exterior-door hinges to which the panel is secured.

The present invention relates to a pet door for use with an existing exterior door in a building. The pet door includes an elongated, rectangular panel 1 having two opposing side edges, an upper edge and a lower edge. A first side edge includes multiple sets of spaced hinge barrels 2 that align with mating hinge barrels 3 on the free, pivotal side edge of the exterior door. A ball-detent locking pin 4 is inserted into the aligned mating barrels to hingedly secure the panel to the exterior door. The exterior-door hinge barrels may each be pivoted into a pocket 5 formed on the free edge to allow the door to properly close against the door frame if the pet door is removed. Furthermore, latches (not pictured) on the interior side of the pet door secure the panel to the door frame to thwart a potential intrusion.

The panel is formed of an upper section 6 that is foldable onto a lower section 7 to allow the device to be compactly transported or stored. The lower section includes a window pane 8 that is formed of an energy-efficient material, such as that commonly referred to as "Low E" glass. Beneath the window pane is an opening 9 having a movable hatch 10 positioned therein that allows a pet to freely pass through the panel. A ferromagnetic plate 11 on a lower edge of the hatch adheres to one or more magnets 12 embedded within the panel to seal the opening immediately after the pet enters or exits. A rigid sheet is slidable within a channel 25 on either side of the panel to prevent a pet from displacing the hatch, if desired.

The upper section of the panel includes a larger, single window pane 13 also formed of an energy-efficient glass. Hingedly attached to the top edge is a triangular flap 14 having a magnet 15 near a peripheral edge for adhering to a ferromagnetic implant on an upper edge of the exterior door. The lower edge of the panel includes a sweep or similar seal that prevents debris and moisture intrusion while also creating friction to prevent the pet door from being inadvertently dislodged by wind or other minor forces.

Accordingly, to install the pet door, a user aligns the panel hinge barrels with those on the exterior door, and inserts the locking pin therein. The door is partially opened and the panel is pivoted against the door frame to block the space formed therebetween. The flap is folded onto the top edge of the door to overlay the triangular space formed between the door and frame header, and the magnet is fastened to the ferromagnetic implant to prevent wind displacement. Therefore, the panel forms a secure barrier between the open door and the exterior door while allowing a pet to freely enter and exit the building. If the pet door is no longer needed, the panel is separated from the door, the flap is folded onto the upper section, which is then folded on to the lower section, and the device is compactly stowed.

The above-described device is not limited to the exact details of construction and enumeration of parts provided herein. Furthermore, the size, shape and materials of construction of the various components can be varied without departing from the spirit of the present invention.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. In combination with an exterior door having a first side edge hingedly attached to a door frame and an opposing free side edge that is pivotal into and out of the door frame, a pet door comprising:

an elongated, rectangular panel having two opposing side edges, an upper edge and a lower edge, wherein said panel is formed of an upper section that is foldable onto a lower section to allow the pet door to be compactly transported or stored;

means for pivotally attaching a first of said two opposing side edges to the opposing free side edge of said exterior door;

an opening on said panel, said opening having a movable hatch positioned therein that allows a pet to freely pass through the panel whereby said exterior door is partially opened and the panel is pivoted against the door frame to block the space formed therebetween to form a secure barrier between the open exterior door and an outdoor area while allowing a pet to freely enter and exit a building; and a flap hingedly attached to a top edge of the panel and configured to extend along a top edge of the exterior door.

2. The combination according to claim 1 wherein said means for pivotally attaching a first of said two opposing side edges to the opposing free side edge of said exterior door comprises:

multiple sets of spaced hinge barrels on the first of said two opposing side edges that align with mating hinge barrels on the free, pivotal side edge of the exterior door;

a locking pin inserted into the hinge barrels to hingedly secure the panel to the exterior door.

3. The combination according to claim 2 wherein the hinge barrels on the free, pivotal side edge of the exterior door are each pivotal into a pocket formed on said free, pivotal side edge to allow the exterior door to close flush against the door frame if the panel is removed.

4. The combination according to claim 1 further comprising a means for securing said hatch to said panel after a pet passes through said opening.

5. The combination according to claim 4 wherein said means for securing said hatch to said panel after a pet passes through said opening comprises a ferromagnetic plate on a lower edge of the hatch, said ferromagnetic plate adhering to at least one magnet embedded within the panel to seal the opening immediately after the pet enters or exits.

6. The combination according to claim 5 further comprising a rigid sheet removably positioned within said opening to prevent a pet from displacing the hatch.

7. The combination according to claim 1 wherein said upper section includes a window pane.

8. The combination according to claim 1 wherein the flap is triangular, said flap having a magnet near an edge for adhering to a ferromagnetic implant on an upper edge of said door.

9. The combination according to claim 1 wherein the lower edge of said panel includes a seal that minimizes debris and moisture intrusion while also creating friction to prevent the pet door from being inadvertently dislodged by external forces.

10. The combination according to claim 8 wherein the lower section includes a window pane.

11. The combination according to claim 10 wherein the window pane of said upper section and the window pane of said lower section are each formed of energy efficient glass.

12. The combination according to claim 2 wherein said locking pin is a ball-detent locking pin.

13. The combination according to claim 5 further comprising:

a channel on either side of the panel;

a rigid sheet slidable within said channel to prevent a pet from displacing the hatch.

* * * * *